US008348714B2

(12) United States Patent
Newton et al.

(10) Patent No.: US 8,348,714 B2
(45) Date of Patent: Jan. 8, 2013

(54) TOY FLYING AIRCRAFT

(75) Inventors: Jean Marie Newton, Torrance, CA (US); Nicholas Amireh, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 476 days.

(21) Appl. No.: 12/455,142

(22) Filed: May 28, 2009

(65) Prior Publication Data

US 2009/0305599 A1 Dec. 10, 2009

Related U.S. Application Data

(60) Provisional application No. 61/130,621, filed on May 30, 2008.

(51) Int. Cl.
*A63H 27/00* (2006.01)

(52) U.S. Cl. ..... 446/61

(58) Field of Classification Search ..... 446/61–68, 446/34, 93, 230–232
See application file for complete search history.

(56) References Cited

U.S. PATENT DOCUMENTS

| | | | | |
|---|---|---|---|---|
| 1,728,937 | A | 9/1929 | Kemp | |
| 1,771,257 | A | 7/1930 | Ingram | |
| 2,157,448 | A * | 5/1939 | Back | 446/61 |
| 2,347,561 | A | 4/1944 | Howard et al. | |
| 2,354,453 | A | 7/1944 | Gazda | |
| 2,361,929 | A | 11/1944 | DeFlorez | |
| 3,092,060 | A | 6/1963 | Reid | |
| 3,118,411 | A | 1/1964 | Koriagin | |
| 3,190,582 | A | 6/1965 | Lippisch | |
| 3,244,246 | A | 4/1966 | Walter | |
| 3,261,575 | A | 7/1966 | Gorton | |
| 3,369,319 | A | 2/1968 | Brown | |
| 3,392,935 | A * | 7/1968 | Allmand | 244/7 R |
| 3,645,474 | A | 2/1972 | Arbuse | |
| 3,949,519 | A * | 4/1976 | Meyer | 446/61 |

(Continued)

FOREIGN PATENT DOCUMENTS

WO WO-2004045735 A1 6/2004

(Continued)

OTHER PUBLICATIONS

Int'l Search Report issued on Sep. 23, 2009 in Int'l Application No. PCT/US09/03287.

(Continued)

*Primary Examiner* — Gene Kim
*Assistant Examiner* — Amir Klayman
(74) *Attorney, Agent, or Firm* — Panitch Schwarze Belisario & Nadel LLP

(57) ABSTRACT

A toy flying aircraft has a fuselage defining a central vertical longitudinal plane, with an upper front portion and a lower rear portion. The upper front and lower rear portions are coupled by a vertical support angling forward and upward from a front upper side of the rear portion to a lower rear side of the front portion. The aircraft has an at least generally circular and horizontally planar wing intersecting the front portion of the fuselage. A forward half of the wing defines an upper horizontal plane generally perpendicular to the central vertical longitudinal plane, and a rear half of the wing is downwardly offset from the upper horizontal plane to define a lift surface. A generally V-shaped planar rear stabilizer is bisected and supported by the rear portion of the fuselage so as to be located vertically entirely below the wing.

20 Claims, 8 Drawing Sheets

U.S. PATENT DOCUMENTS

| | | | | |
|---|---|---|---|---|
| 3,957,230 | A | 5/1976 | Boucher et al. | |
| 4,103,454 | A | 8/1978 | Stone | |
| 4,106,232 | A * | 8/1978 | Higgins | 446/64 |
| 4,206,411 | A | 6/1980 | Meyer | |
| 4,253,897 | A | 3/1981 | Pistone | |
| 4,624,425 | A | 11/1986 | Austin et al. | |
| 4,848,700 | A | 7/1989 | Lockheed | |
| 4,899,954 | A | 2/1990 | Pruszenski, Jr. | |
| D307,923 | S * | 5/1990 | Probert | D21/451 |
| 5,035,382 | A | 7/1991 | Lissaman et al. | |
| 5,046,979 | A | 9/1991 | Ragan et al. | |
| 5,050,817 | A | 9/1991 | Miller | |
| 5,065,833 | A | 11/1991 | Matsuoka et al. | |
| 5,078,638 | A | 1/1992 | Molina | |
| 5,082,204 | A | 1/1992 | Croston | |
| 5,087,000 | A | 2/1992 | Suto | |
| 5,178,088 | A | 1/1993 | Howard | |
| 5,242,132 | A | 9/1993 | Wukowitz | |
| 5,269,249 | A | 12/1993 | Micheletti | |
| 5,357,894 | A | 10/1994 | Jacobson | |
| 5,562,061 | A | 10/1996 | Crocker | |
| 5,634,839 | A | 6/1997 | Dixon | |
| 5,727,495 | A | 3/1998 | Reslein | |
| 5,758,844 | A | 6/1998 | Cummings | |
| 5,853,312 | A | 12/1998 | Li | |
| 6,014,940 | A | 1/2000 | Jacobson | |
| 6,113,028 | A | 9/2000 | Lohse et al. | |
| 6,131,848 | A | 10/2000 | Crow | |
| 6,158,540 | A | 12/2000 | Rice et al. | |
| 6,164,591 | A | 12/2000 | Descatha | |
| 6,217,404 | B1 | 4/2001 | Liao | |
| 6,257,946 | B1 | 7/2001 | Yang | |
| 6,435,932 | B1 | 8/2002 | Lynn | |
| 6,450,852 | B1 * | 9/2002 | Arredondo | 446/61 |
| 6,478,650 | B1 | 11/2002 | Tsai | |
| 6,517,026 | B1 | 2/2003 | Smith | |
| 6,568,980 | B2 | 5/2003 | Barthold | |
| 6,592,073 | B1 | 7/2003 | Meekins | |
| 6,612,893 | B2 | 9/2003 | Rehkemper et al. | |
| 6,679,753 | B1 | 1/2004 | Motosko | |
| 6,732,672 | B2 | 5/2004 | Shin et al. | |
| 6,824,093 | B1 | 11/2004 | Haseloh et al. | |
| 6,912,967 | B1 | 7/2005 | Oats et al. | |
| 7,073,750 | B1 | 7/2006 | Choi | |
| 7,275,973 | B2 | 10/2007 | Ong | |
| 2002/0106961 | A1 | 8/2002 | Barthold | |
| 2003/0040247 | A1 * | 2/2003 | Rehkemper et al. | 446/34 |
| 2003/0136873 | A1 | 7/2003 | Churchman | |
| 2004/0195438 | A1 | 10/2004 | Chamberlain | |
| 2005/0233672 | A1 * | 10/2005 | Shantz | 446/232 |
| 2006/0144995 | A1 | 7/2006 | Clancy | |
| 2007/0259595 | A1 | 11/2007 | Amireh et al. | |
| 2008/0014827 | A1 | 1/2008 | Amireh et al. | |

FOREIGN PATENT DOCUMENTS

| | | | |
|---|---|---|---|
| WO | WO-2007090156 | A2 | 8/2007 |

OTHER PUBLICATIONS www.rocketreviews.com/reviews/all/oop_est_star_trek_enterprise.shtnnl, Beginning thread starts on Oct. 20, 2003 (10 pages in color). Estes Industries Star Trek Starship Enterprise, OOP Model. Estes®.

http://plans.rocketshoppe.conn/estes/est1275/est1275.htm. Plans for Estes Industries Model No. 1275 U.S.S. Enterprise Flying Model Rocket. (16 pages). undated.

* cited by examiner

TOY FLYING AIRCRAFT

CROSS-REFERENCE TO RELATED APPLICATIONS

The present application claims the benefit of U.S. Provisional Patent Application No. 61/130,621, filed on May 30, 2008 and entitled "Toy Flying Trek Aircraft," which is herein incorporated by reference in its entirety.

BACKGROUND OF THE INVENTION

The present invention relates generally to toy flying aircraft, and, more particularly, to toy flying aircraft, preferably those styled after science fiction spaceships, that can be flown unpowered as gliders or powered, with or without remote control, for an extended period of time due to their unique structure.

Toy flying aircraft are generally known. Consumers today desire relatively inexpensive toy flying aircrafts that have structure that mimics the appearance of a life-size realistic or fanciful aircraft. Furthermore, consumers today desire toy flying aircraft having structure that allows the aircraft to stay airborne or fly for an extended period of time. Unfortunately, it can be difficult to create a toy flying aircraft that successfully combines the above-identified features for a variety of reasons.

Therefore, it would be desirable to create a toy flying aircraft that can be flown for an extended period of time, either unpowered as a glider or powered by remote control, for example, that mimics the appearance of a life-size realistic or fanciful aircraft. Specifically, it would be desirable to create a toy flying aircraft out of generally planar semi-rigid stock material that is modeled after the fictional and imaginary star ships "Enterprise" created for the Star Trek science fiction television series and movies and that is capable of staying airborne for an extended period of time due to its unique structural features.

BRIEF SUMMARY OF THE INVENTION

Briefly stated, the present invention is a toy flying aircraft that includes a fuselage having a central vertical longitudinal plane. The fuselage has an upper part forming a front portion thereof and a lower part forming a rear portion thereof. The front portion and rear portion being coupled by a vertical support angling generally forward and upward from a front upper side of the rear portion to a lower rear side of the front portion. A generally circular wing in the form of an at least generally horizontally planar disk intersecting the front portion of the fuselage. The central vertical longitudinal plane bisecting the wing into two generally equal halves and a geometric center of the wing being generally fixedly connected to and supported by the front portion of the fuselage. One diameter of the wing being defined as extending through the geometric center thereof and generally perpendicularly to the central vertical longitudinal plane. The one diameter bisecting the wing into a first portion and a second portion. The first portion of the wing being forward of the one diameter and defining an upper horizontal plane generally perpendicular to the central vertical longitudinal plane. The second portion of the wing being rearward of the one diameter and downwardly offset from the upper horizontal plane defining a lift surface. A generally V-shaped rear stabilizer bisected and supported by the rear portion of the fuselage so as to locate the rear stabilizer at least substantially behind the wing and vertically entirely below the upper horizontal plane.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings several embodiments which are presently preferred. It should be understood, however, that the invention is not limited to the precise arrangements and instrumentalities shown.

In the drawings.

DETAILED DESCRIPTION OF THE INVENTION

Figure 1:
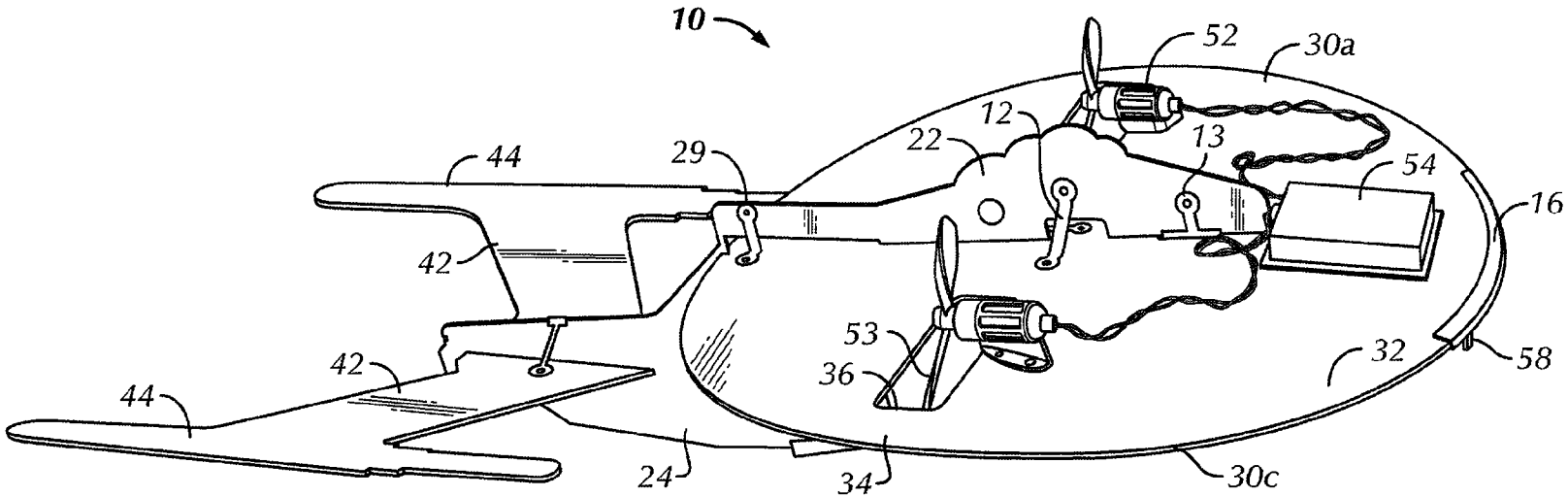
FIG. 1 is perspective view of the front, top and right side of a toy flying aircraft in accordance with a presently preferred embodiment of the present invention.

Certain terminology is used in the following description for convenience only and is not limiting. The words "right," "left," "upper," and "lower" designate directions in the drawings to which reference is made. The words "first" and "second" designate an order of operations in the drawings to which reference is made, but do not limit these steps to the exact order described. The words "inwardly" and "outwardly" refer to directions toward and away from, respectively, the geometric center of the aircraft and designated parts thereof. Additionally, the term "a," as used in the specification, means "at least one." The terminology include the words above specifically mentioned, derivatives thereof, and words of similar import. Finally, the words "horizontal" and "planar" are relative as opposed to absolute terms.

Referring to the drawings in detail, wherein like numerals indicate like elements throughout, there is shown in FIGS. 1-6 variations of a preferred embodiment toy flying aircraft, generally designated 10, in accordance with the present invention. In the preferred embodiment, the aircraft 10 is modeled after the fictional and imaginary star ships "Enterprise" created for the Star Trek science fiction television series and movies. However, it is understood by those skilled in the art that the specific structure, systems and/or mechanisms described herein may be employed in virtually any type or style of toy aircraft, airplane, spaceship and/or glider.

Preferably, the aircraft 10 is two-dimensional ("2D") or "flat" in the sense that each of its main body components is built and/or formed of generally planar, relatively thin foam sheet or similarly thin and planar stock material of at least generally uniform thinness. The main body components of the aircraft 10 are at least generally, but not necessarily exactly flat, giving the components a two-dimensional appearance. The material employed is preferably sufficiently rigid to maintain its general form, yet resiliently flexible to provide the angularity described. Moreover, depending upon the material selected, it can be bent to a permanent extent by appropriate manufacturing techniques for the materials selected (e.g. heat and pressure with or without moisture) or forced into the angularity described by stops/bracketry/bracing or both. For example, the aircraft 10 may formed a ¼ or 3/16 inch thick polystyrene foam sheet stock, but could be built from balsa or other foam(s) or laminated plastic(s) or other similarly relatively rigid yet light weight material. Alternatively, the aircraft 10 may be given for a more three-dimensional ("3D") appearance. More particularly, the aircraft 10 may be built from shaped foam block material (not shown), for example, may use a planar frame that is covered on each of its major structures with preferably shaped retaining, non-porous, thin, sheet polymer material, for example ten millimeter thick polyethylene terephthalate ("PET") sheet to present a more 3D representation of the aircraft (also not shown).

Figure 2:
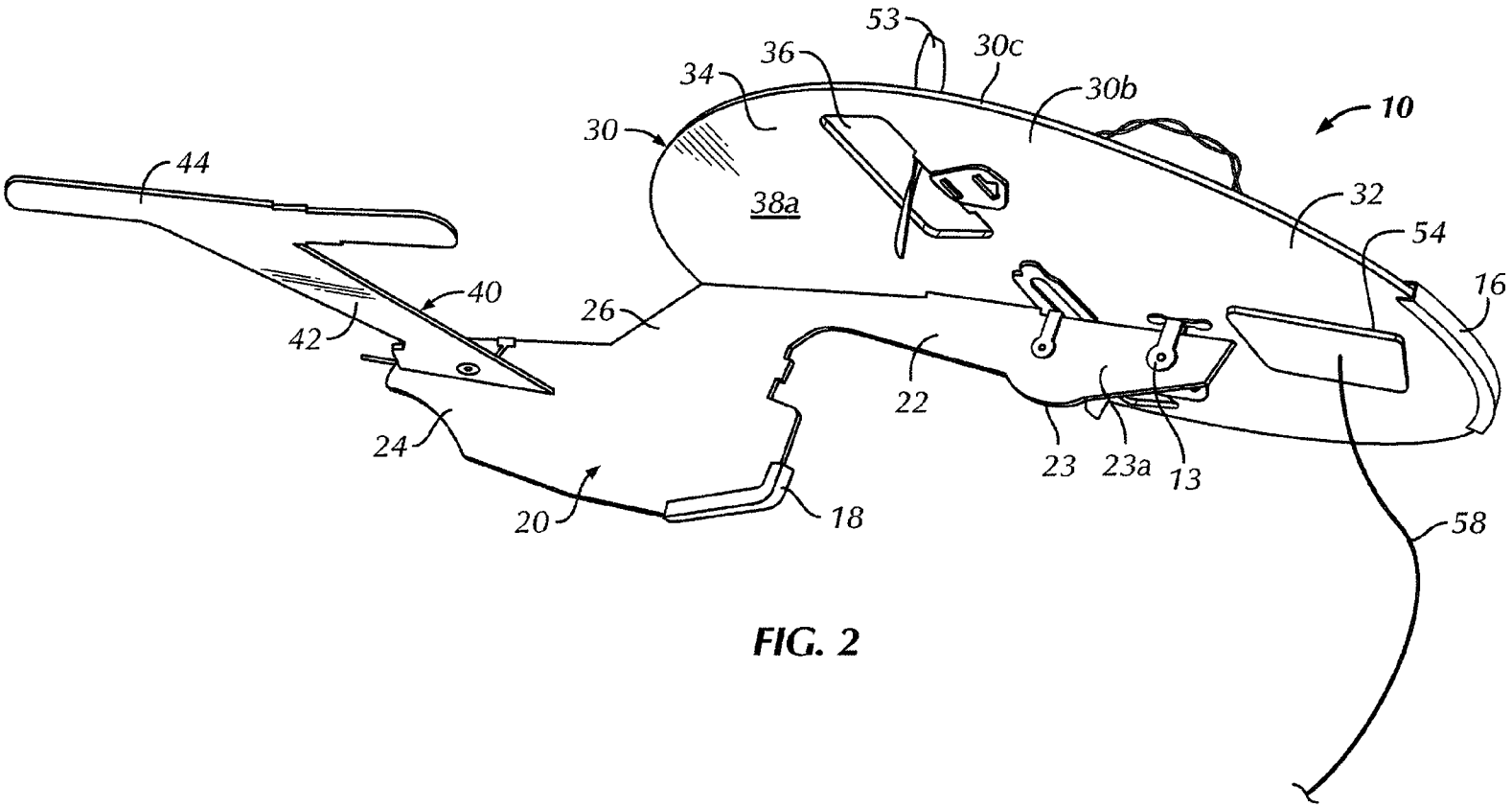
FIG. 2 is a perspective view of the front, bottom and right side of the aircraft shown in FIG. 1.
Figure 3:
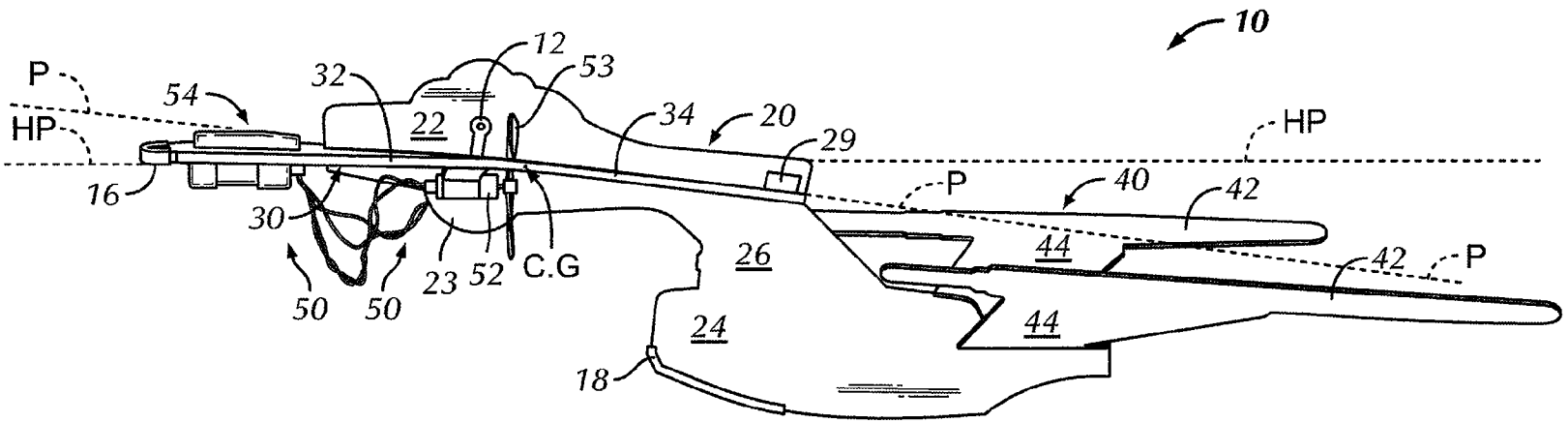
FIG. 3 is a left side elevation view of the aircraft shown in FIGS. 1 and 2, with a propulsion and control system being shown in an alternative configuration and/or position.
Figure 4:
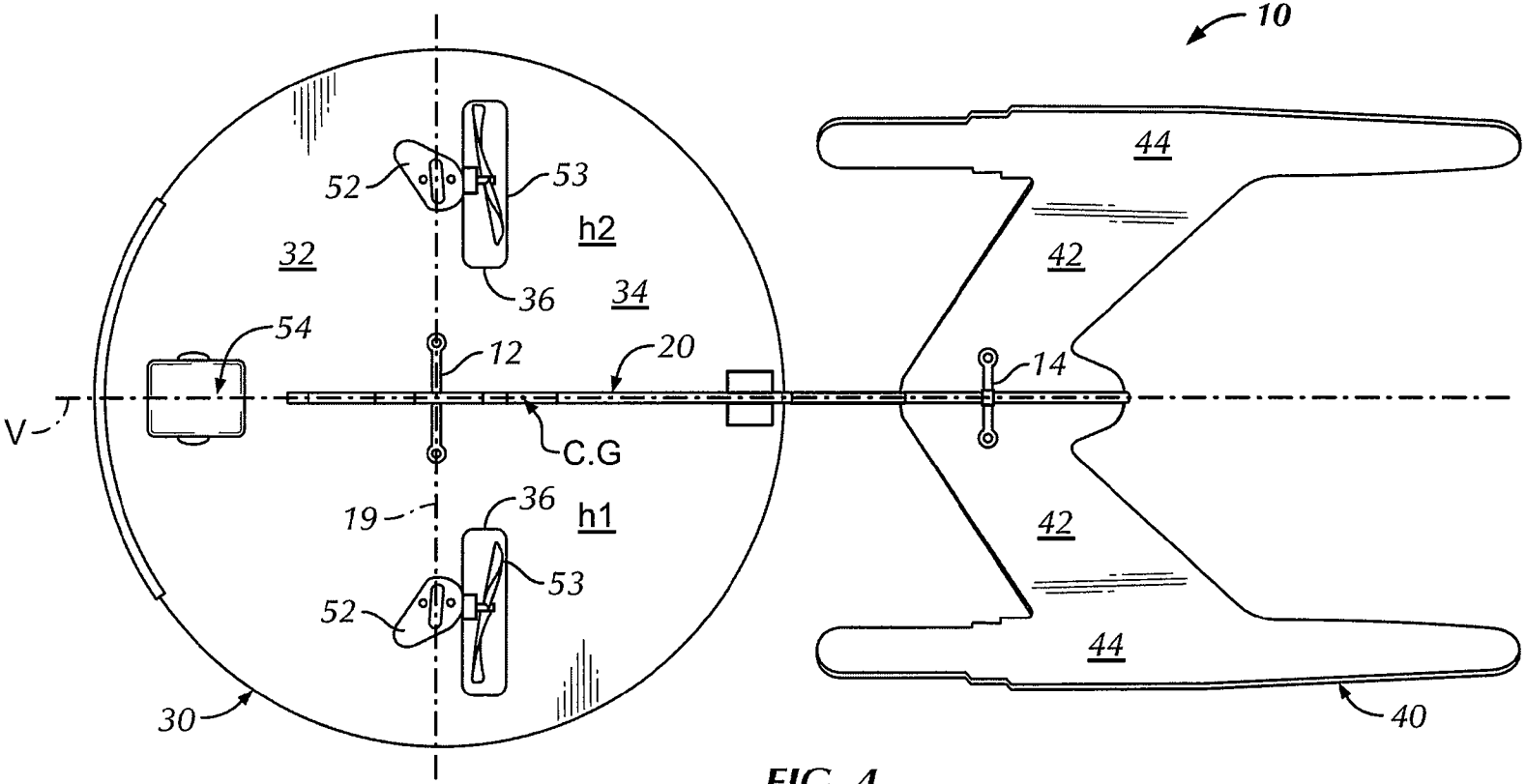
FIG. 4 is a top plan view of the aircraft shown in FIG. 3.

Referring to FIGS. 1-6, the aircraft 10 includes a fuselage 20 preferably at least generally vertically planar 20 defining a central vertical longitudinal plane V (see FIGS. 4-6) of the aircraft 10. As best seen in FIG. 4, the aircraft 10 is generally symmetric with respect to the central vertical longitudinal plane V. However, the aircraft 10 is not limited to such a configuration. The fuselage 20 preferably includes an upper part 22 forming a front portion thereof (also indicated at 22) and a lower part 24 forming a rear portion thereof (also indicated at 24). Further, the front and rear portions 22, 24 of the fuselage 20 are preferably integrally connected by a vertical support 26 angling generally forwardly and upwardly from a front upper side of the rear portion 24 to a rear lower side of the front portion 22. The front and rear portions 22, 24 of the fuselage 20 of the present embodiment are nearly the same length, with the front portion 22 preferably being slightly the longer of the two.

Referring again to FIGS. 1-6, the aircraft 10 further includes a wing 30 preferably at least generally or approximately circular in shape when viewed from above or below (see FIG. 4). In the present embodiment, the wing 30 is in the form of an at least generally horizontally planar disk or "saucer," which intersects at least a segment of the front portion 22 of the fuselage 20. In the present embodiment, at least a portion of the upper part 22 of the fuselage 20 extends above and below the wing 30. Preferably, the wing 30 is split (i.e., includes a cut-out) along about half of its length to be received on either lateral side of the fuselage 20. As an example, for a seven and one-half inch diameter wing 30 of the aforesaid material, the split of a rear portion 34 of the wing 30 from a forward-most intersection between the fuselage 20 and the wing 30 begins about four inches from the front edge of the wing 30 (i.e. slightly rearward of one diameter 19 in particular described in detail below, which is perpendicular to fuselage 20 and central vertical plane V). At least one forward brace 12 preferably permanently or removably secures the wing 30 to the fuselage 20. Lift is provided primarily, if not essentially, by shaping the wing 30 front to rear to form an airfoil, as described in detail below. The term "airfoil" is defined herein as a predetermined shape that when moved through a fluid produces a force generally perpendicular to the motion.

In the preferred embodiment, the wing 30 preferably is made of planar sheet stock material and includes a generally horizontally planar first or top surface 30*a*, an opposing generally horizontally planar second or bottom surface 30*b*, and an outer circumferential edge 30*c* that extends around an entire perimeter of the wing 30 generally perpendicular to and extending between the top and bottom surfaces 30*a*, 30*b*. The central vertical longitudinal plane V preferably bisects the wing 30 into two generally equal halves h1, h2. A geometric center of the wing 30 is preferably generally fixedly connected to and supported by the front portion 22 of the fuselage 20. The wing 30 thus intersects the front portion 22 of the fuselage 20 and preferably runs the entire length of the front portion. The circular wing 30 can further be shaped with a slight bend to form a dihedral angle suggestedly about ten degrees or less (i.e. 160 degrees top surface h1 to top surface h2) for greater roll stability. Also, a dihedral angle is provided along at least a majority of the length of the wing 30 and suggestedly at least from the intersection of the wing 30 with the fuselage 20 and rearward. The wing 30 preferably has a dihedral bend of about five degrees (i.e. about 175° from top surface of h1 to top surface of h2) in the first portion 32 increasing to about ten degrees (i.e. about 170° from top surface of h1 to top surface of h2) at the rear end of the rear portion 34.

In the preferred embodiment, the one diameter 19 of the wing 30 in particular is defined as extending through the geometric center thereof and perpendicular to the central vertical longitudinal plane V. Preferably, a Center of Gravity (C.G.) of the aircraft 10 is located along or proximal to the one diameter 19, which extends across a widest part of the wing 30. The one diameter 19 of the wing 30 bisects the wing 30 into the first or front portion 32 and the second or rear portion 34. The front portion 32 of the wing 30 is located forward of the one diameter 19 and defines an upper horizontal plane HP (see FIG. 3) of the wing 30 generally perpendicular to the central vertical longitudinal plane V.

As mentioned above, lift is generated, at least in part, by flexing the wing 30 downwardly along at least part of its length. More particularly, the rear portion 34 of the wing 30, which is located rearward of the one diameter 19, preferably defines a plane P (see FIG. 3) tangent to at least a majority of its upper surface or between the front and rear ends of the rear portion 34 if the wing 30 or rear portion 34 is uniformly curved, that is generally offset (i.e. pitched downward) from the upper horizontal plane HP at a predetermined angle. The bottom surface of the rear portion 34 of the wing 30 defines a lift surface as discussed in detail below. The plane P defined by the rear portion 34 of the wing 30 is preferably angled about 10 degrees from the upper horizontal plane HP. However, it is understood by those skilled in the art that this angle could be increase or decreased depending on the amount of lift needed and that the rear portion 34 can be more generally curved along the fuselage 20 instead of being generally planar as shown. This flex in the longitudinal direction is in addition to the flex in the lateral direction providing the dihedral angle of the wing 30.

Preferably, the front portion 32 of the wing 30 is generally solid and/or unitary until it intersects a portion of the fuselage 20 approximately at or above a downwardly extending chin-like protrusion 23 of the front portion 22 thereof. From this intersection rearward, as mentioned above, the rear portion 34 of the wing 30 is preferably split so as to extend along the lateral sides of the front portion 22 of the fuselage 20 and is angled downwardly towards the rear of the aircraft 10 so as to create downward facing lift surfaces 38*a*, 38*b* by presenting a positive angle of attack to the airflow. At least one stop 29 is preferably located on each side surface of the fuselage 20 to generally maintain the generally angled position of the second portion 34 of the wing 30. Specifically, rear ends of the lift surfaces 38*a*, 38*b* may be retained in their flexed position by the stop(s) 29 or other suitable means that are connected directly to the fuselage 30.

There are at least two differences between FIG. 2 and FIG. 3. First, the upper portion 22 of the fuselage 20 in FIG. 2 extends forwardly of the chin-like protrusion 23 beneath wing 30 as indicated at 23*a* to approximately equal the length of the upper portion 22 above the wing 30 whereas it does not extend so far in FIG. 3. Second, the extension 23*a* supports an additional brace 13 between the fuselage 20 and wing 30.

Figure 7:
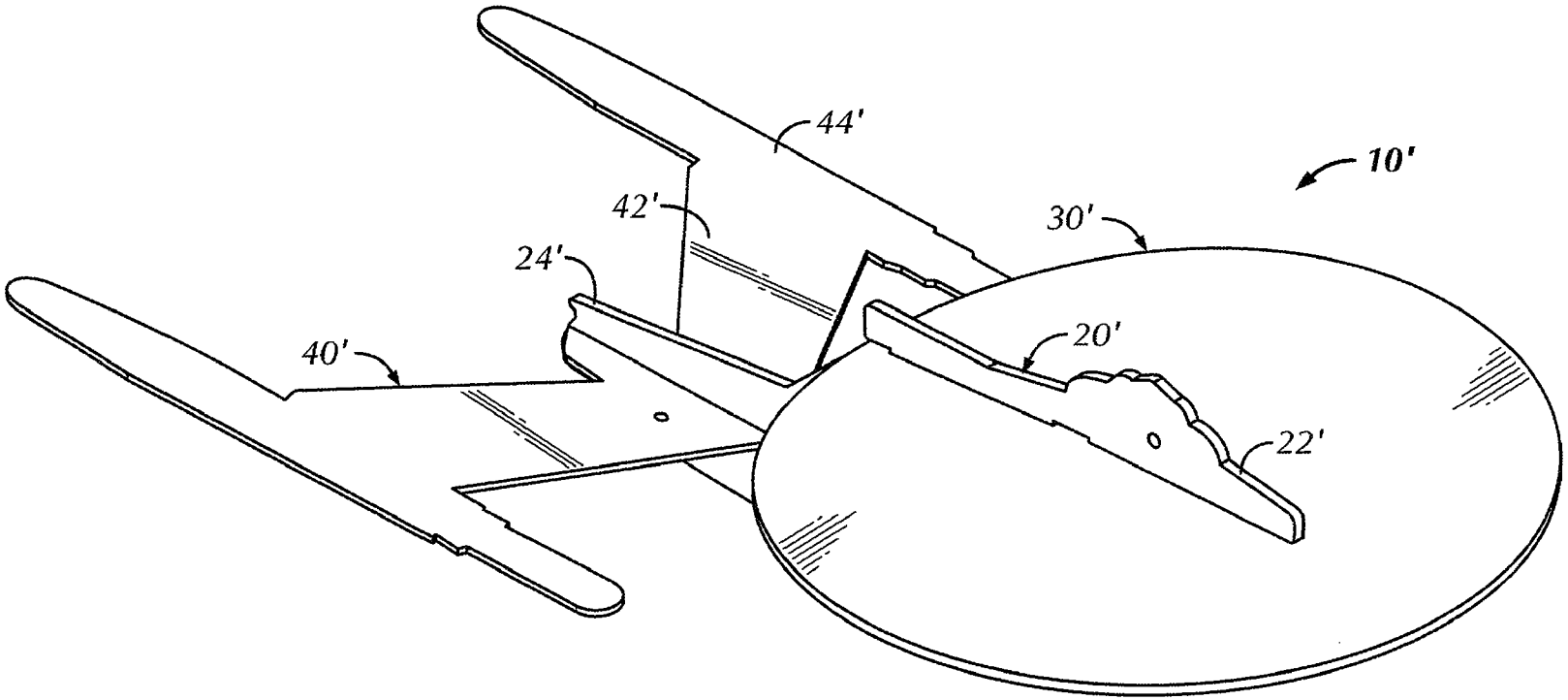
FIG. 7 is a perspective view of the front, top and right side of slightly modified glider version of the aircraft shown in FIGS. 1-6, with the propulsion and control system omitted.
Figure 8:
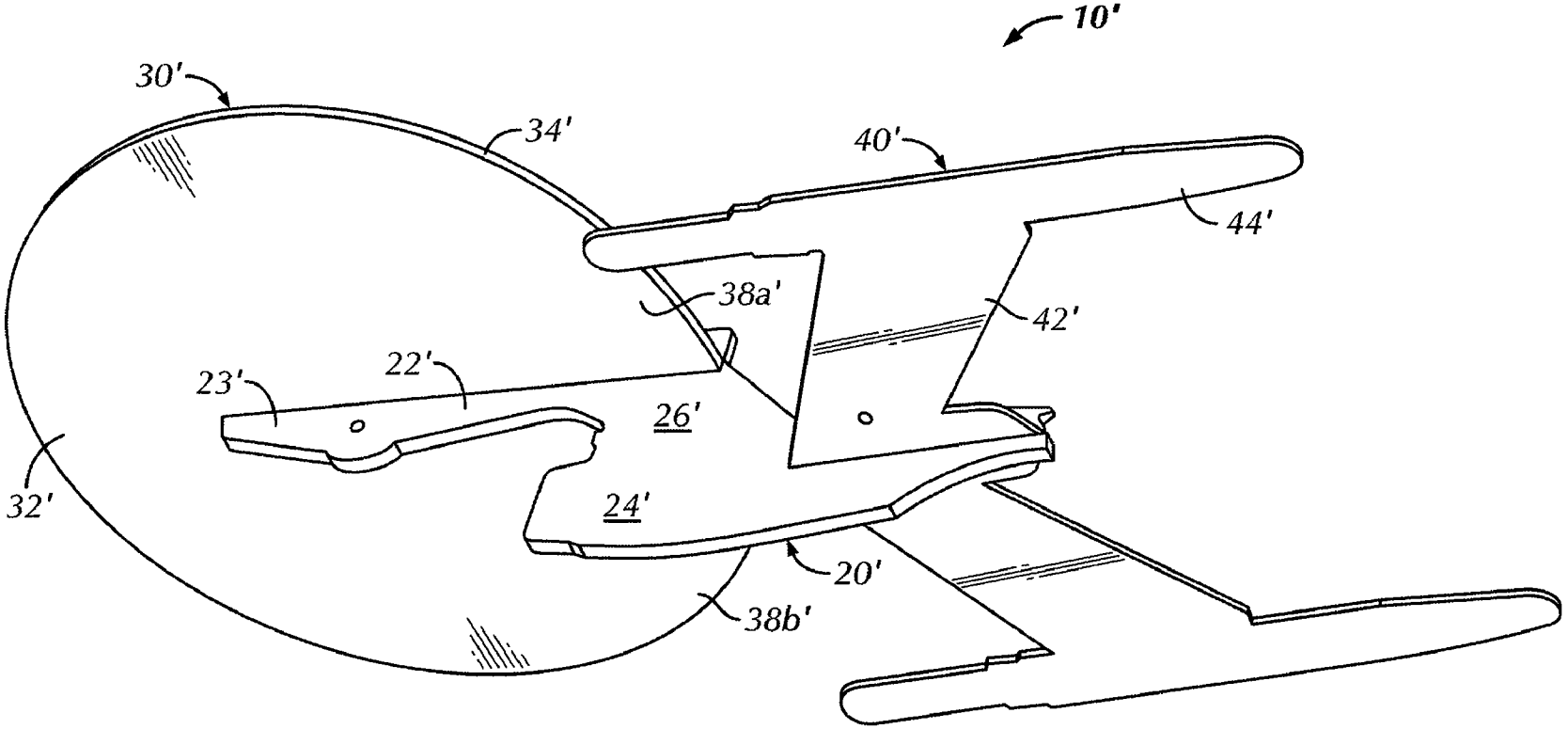
FIG. 8 is a perspective view of the rear, bottom and left side of the aircraft shown in FIG. 7.

As seen in FIGS. 1, 2 and 4, the wing 30 includes at least one but preferably two spaced-apart slots or openings 36 located a predetermined distance inwardly from the outer circumferential edge 30*c* of the wing 30. The laterally-extending slots 36 are generally rectangular in shape when viewed from above or below (see FIG. 4) and extend generally perpendicular to the central vertical longitudinal plane V. The slots 36 extend completely through the wing 30 from the top surface 30*a* to the bottom surface 30*b* thereof and preferably are located in the second portion 34 of the wing 30 rearward of the one diameter 19. One of the two slots 36 is located in each of the halves h1, h2 of the wing 30. Alternatively, as seen FIGS. 7 and 8, the top and bottom surfaces 30*a*', 30*b*' of the wing 30' of a glider version 10' may be completely solid such that no slots 36 extend therethrough.

Figure 5:
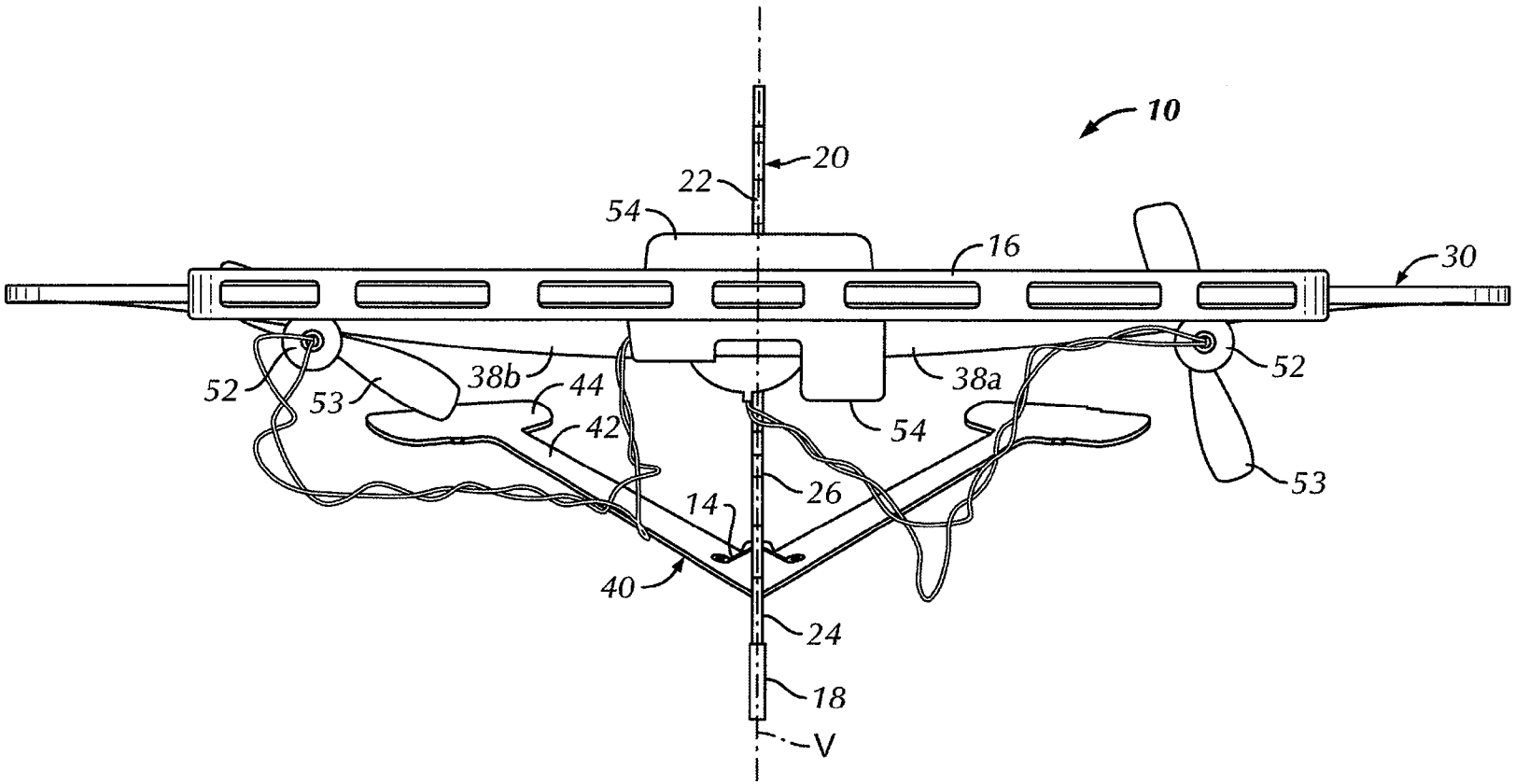
FIG. 5 is a front elevation view of the aircraft shown in FIG. 3.

As seen in FIGS. 1-5, a protective bumper 16 of a stronger material than that used to construct the fuselage 20 and wing 30, such as a non-porous polymer, may be provided along a front edge of the wing 30 to protect it from damage. Similarly, as seen in FIGS. 2, 3 and 5, a protective bumper 18 may also or alternatively be provided along a bottom front edge of the lower portion 24 of the fuselage 20 to protect it from damage.

Referring to FIGS. 1-6, for powered flight, a propulsion and control system, generally indicated at 50, is provided on or embedded within at least a portion of the wing 10. The propulsion and control system 50 includes at least one but preferably two-spaced apart and identical electric motors 52 supported from the wing 30. Each motor 52 is located at least proximal the one diameter 19 or widest part of the wing 30 and each motor 52 is preferably located as far forward as possible while still providing propulsion and steering control. Each motor 52 is preferably operatively coupled with at least one identical propeller 53 in a pusher configuration so as to rotate the propeller 53 to propel the aircraft 10 in a forward direction.

Preferably, each motor 52 and propeller 53 is located proximate one of the two slots 36, such that at least a portion of each propeller 53 extends through at least a portion of one of the slots 36 during operation thereof. Thus, in operation, a portion of each propeller 53 rotates into and within each slot 36. The motors 52 may be fixedly attached to the top surface 30*a* of the wing 30 as seen in FIGS. 1-2, or alternatively, as seen in FIGS. 3-6, to the bottom surface 30*b* of the wing 30. As best seen in FIG. 3, the Center of Gravity (C.G.) is located proximal the intersection of the forward and rearward portions 32, 34 of the wing 30 and suggestedly even more proximal the propellers 53.

In the preferred embodiment, the propulsion and control system 50 further includes a power supply (not shown), such as rechargeable or disposable batteries or, more preferably, rechargeable capacitor(s) operatively connected to the motors 52. Specifically, the aircraft 10 is controlled by a controller (not shown), which, in this embodiment, is located together with the power supply in a housing 54 either fixedly attached to or embedded within the wing 30 forward of the fuselage 20. The central vertical longitudinal plane V preferably generally bisects the housing 54 to generally maintain an equal balance of weight on each side of the central vertical longitudinal plane V. For remote control, the system 50 preferably includes a wireless signal receiver or antenna 58 and processing circuitry (not shown) sufficient to at least independently control rotational speed of the motors 52 for differential thrust vectoring directional control. It will be appreciated that the aircraft 10 may be operated without differential thrust vectoring for uncontrolled powered flight.

Figure 6:
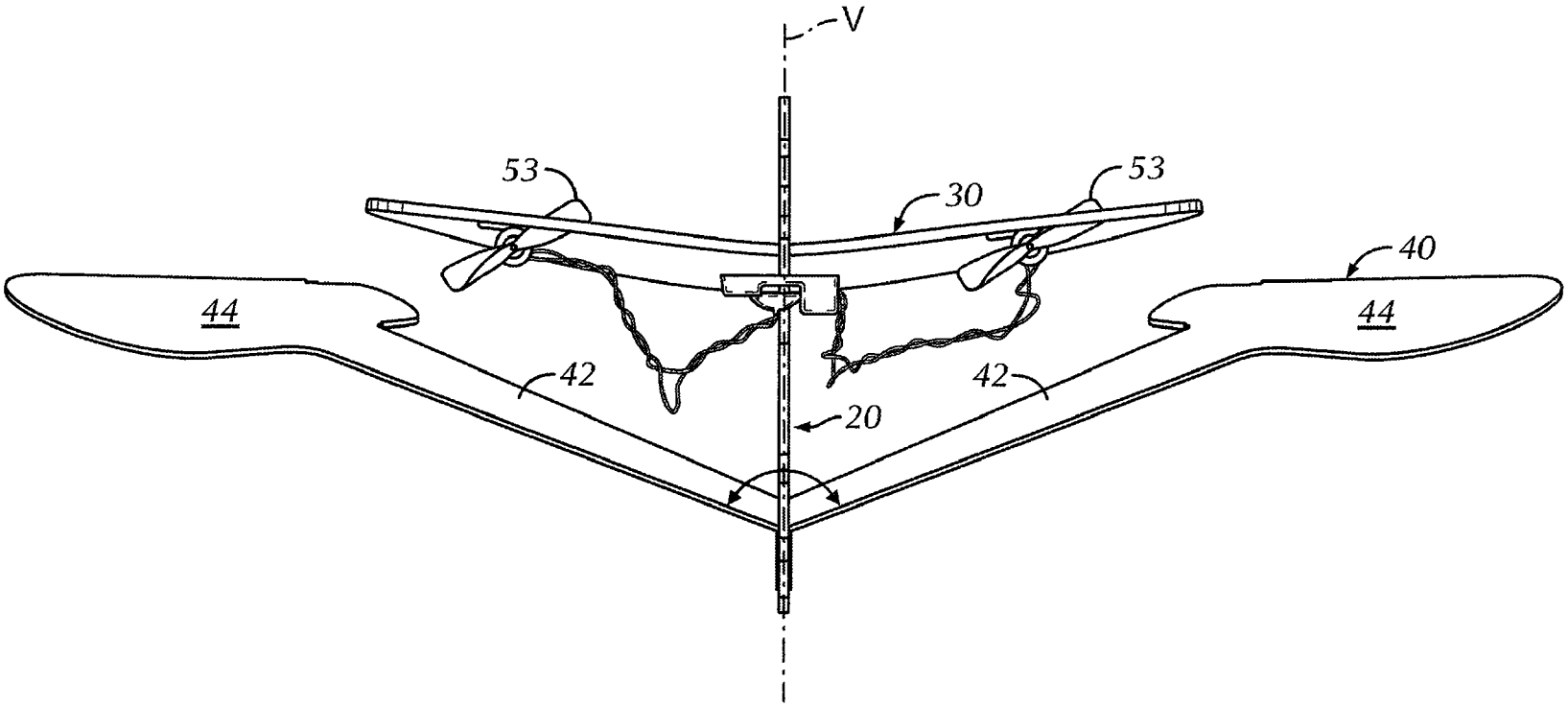
FIG. 6 is a rear elevation view of the aircraft shown in FIG. 3.

Referring again to FIGS. 1-6, the toy flying aircraft 10 preferably includes a rear stabilizer 40 which is generally horizontal and which intersects and is supported by the rear portion 24 of the fuselage 20 so as to vertically locate the rear stabilizer 40 entirely beneath the upper horizontal plane HP defined by the first portion 32 of the wing 30 and at least substantially and preferably entirely behind the wing 30. The rear stabilizer 40 is preferably shaped to represent a pair of longitudinally extending, generally planar motor nacelles 44 supported at outermost ends of a pair of opposing and generally planar struts 42. Preferably the rear stabilizer 40 is generally V-shaped in elevation and plan views (FIGS. 5-6 and 4, respectively). The rear stabilizer 40 is preferably one piece with a front half slot cut out along the center line about one-half the length of the center of the rear stabilizer 40 and of a width sized to fit snuggly around the lateral sides of the rear end of the rear portion 24 of the fuselage 20. The extreme rear end of the rear portion 24 of fuselage 20 has a slot of approximately the same width and length to snuggly receive the remaining solid center portion of the rear stabilizer 40.

In the preferred embodiment, the central vertical longitudinal plane V preferably bisects the rear stabilizer 40 and pair of struts 42. Each strut 42 extends laterally outwardly from the fuselage 20 and preferably upwardly and rearwardly with respect to the fuselage 20, terminating with the nacelles 44. The struts 42 and nacelles 44 stabilize the aircraft 10 both horizontally (yaw) and vertically (pitch).

Preferably, the pair of struts 42 and/or nacelles 44, or at least forward ends thereof, are neutrally angled or angled a predetermined degree downwardly, with respect to the upper horizontal plane HP forming the front portion 32 of the wing 30, as they extend forwardly so as to present a negative angle of attack to promote downward movement of the rear portion 24 of the fuselage 20 and increase the angle of attack of the wing 30 during flight. The struts 42 are flexed upwardly as they extend outwardly from the fuselage 20 at a dihedral angle of less than thirty degrees (i.e., more than 120° from top surface to top surface), suggestedly about twenty-five degrees or less (i.e. about 130° or more top surface to top surface as in FIG. 6) ranging down to less than ten degrees (i.e. more than 160° more top surface to top surface in FIGS. 1-2). The nacelles 44 may also be flexed downward into anhedral angles with respect to struts 42 (not depicted), if desired. At least one rearward brace 14 preferably secures the rear stabilizer 40 to the fuselage 20 and generally maintains the dihedral angle of the struts 42. It is believed that the positioning of the rear stabilizer 40 behind and beneath the wing 30, where it is intersected by a rearward projection of the downwardly offset rear portion 34 of the wing 30, and air flow from the bottom side of the wing 30, increases airflow over the rear stabilizer 40 to maintain the aircraft 10 stable in flight at the relatively low speeds provided by the small electric motors 52 used in these toy aircraft.

More information about various aspects of flying toy aircraft, particularly twin engine control, are found in U.S. Pat. No. 7,275,973 and, particularly those constructed of foam sheet material like the present invention, are further found in U.S. Patent Publication No. 2007/0259595 A1, both of which are incorporated by reference herein in their entireties.

The surface decorations depicted in originally filed FIGS. 1-2 are not relevant to the invention and can be ignored.

It will be appreciated by those skilled in the art that changes could be made to the embodiments described above without departing from the broad inventive concept thereof. For example, the motors 52, propellers 53 and housing 54 with controller and power supply can be deleted and the remainder of aircraft 10 used as a glider even with slots 36. It is understood, therefore, that this invention is not limited to the particular embodiments disclosed, but it is intended to cover modifications within the spirit and scope of the present invention.

We claim:

1. A toy flying aircraft comprising:

a fuselage having a central vertical longitudinal plane, the fuselage including an upper part forming a front portion thereof and a lower part forming a rear portion thereof, the front portion and rear portion being coupled by a vertical support angling generally forward and upward from a front upper side of the rear portion to a lower rear side of the front portion;

a generally circular wing in the form of an at least generally horizontally planar disk intersecting the front portion of the fuselage, the central vertical longitudinal plane bisecting the wing into two generally equal halves, a geometric center of the wing being generally fixedly connected to and supported by the front portion of the fuselage, one diameter of the wing being defined as extending through the geometric center thereof and generally perpendicularly to the central vertical longitudinal plane, the one diameter bisecting the wing into a first portion and a second portion, the first portion of the wing being forward of the one diameter and defining an upper horizontal plane generally perpendicular to the central vertical longitudinal plane, the second portion of the wing being rearward of the one diameter and downwardly offset from the upper horizontal plane defining a lift surface; and a generally V-shaped rear stabilizer bisected and supported by the rear portion of the fuselage so as to locate the rear stabilizer at least substantially behind the wing and vertically entirely below the upper horizontal plane.

2. The toy flying aircraft of claim 1 wherein the fuselage, wing and rear stabilizer are each formed of generally planar sheet stock material.

3. The toy flying aircraft of claim 1 wherein the rear stabilizer includes a pair of generally planar struts intersecting and supported by the rear portion of the fuselage, each strut extends laterally outwardly and upwardly from the fuselage.

4. The toy flying aircraft of claim 3 wherein the pair of struts forms a dihedral angle with top surfaces of the pair of struts being at least 130 degrees apart.

5. The toy flying aircraft of claim 4 further comprising bracing to secure the pair of struts to the fuselage and maintain the dihedral angle of the struts.

6. The toy flying aircraft of claim 3 wherein the rear stabilizer further includes a generally planar nacelle extending longitudinally from an end of each strut.

7. The toy flying aircraft of claim 6 wherein at least a forward end of each nacelle is provided with a negative angle of attack.

8. The toy flying aircraft of claim 6 wherein each nacelle is angled forwardly downwardly so as to promote downward movement of the rear portion of the fuselage during flight.

9. The toy flying aircraft of claim 1 further comprising a stop on each lateral side of the fuselage to maintain the downward offset of the second portion of the wing from the upper horizontal plane.

10. The toy flying aircraft of claim 1 wherein the second portion of the wing defines a plane angled downward about 10 degrees from the upper horizontal plane.

11. The toy flying aircraft of claim 1 further comprising:

at least one electric motor supported from the wing and operatively coupled with at least one propeller so as to rotate the at least one propeller to propel the aircraft in a forward direction.

12. The toy flying aircraft of claim 1 further comprising:

two spaced-apart electric motors supported from the wing on opposite lateral sides of the fuselage;

two propellers, each propeller being operatively coupled with a separate one of the two motors so as to propel the aircraft in a forward direction; and two slots, each slot being located on an opposite lateral side of the fuselage a predetermined distance inwardly from an outer circumferential edge of the wing and extending through the wing, at least a portion of each propeller extending through one of the slots during operation.

13. The toy flying aircraft of claim 12 wherein the motors are located on the first portion of the wing.

14. The toy flying aircraft of claim 1 wherein the wing extends forwardly of as well as along the length of the front portion of the fuselage.

15. The toy flying aircraft of claim 1 wherein the forward and rearward portions of the fuselage are approximately the same length.

16. The toy flying aircraft of claim 1 having a center of gravity located along the vertical plane proximal to the one diameter.

17. The toy flying aircraft of claim 1 wherein the front portion of the circular wing has a planar upper surface.

18. The toy flying aircraft of claim 1 wherein the circular wing has a uniform thickness between opposing upper and lower outer surfaces of the circular wing.

19. The toy flying aircraft of claim 2 wherein the planar sheet stock material forming the wing is of uniform thickness perpendicular to the plane of the sheet stock material so as to provide the wing with a uniform thickness between opposing upper and lower outer surfaces of the circular wing.

20. The toy flying aircraft of claim 19 wherein the planar sheet stock material forming the fuselage is of uniform thickness perpendicular to plane of the sheet stock material so as to provide the fuselage with planar vertical sides parallel to the central vertical longitudinal plane.

* * * * *